US005545313A

United States Patent [19]

Tagamolila

[11] Patent Number: 5,545,313

[45] Date of Patent: Aug. 13, 1996

[54] DESALTING PROCESS FOR PRIMARY FRACTIONATOR

[75] Inventor: Constante P. Tagamolila, Arlington Heights, Ill.

[73] Assignee: UOP, Des Plaines, Ill.

[21] Appl. No.: 262,721

[22] Filed: Jun. 20, 1994

[51] Int. Cl.[6] ..... B01D 3/34

[52] U.S. Cl. ..... 208/348; 208/308

[58] Field of Search ..... 208/348, 308

[56] References Cited

U.S. PATENT DOCUMENTS

| | | | |
|---|---|---|---|
| 4,062,764 | 12/1977 | White et al. | 208/348 |
| 4,229,284 | 10/1980 | White et al. | 208/348 |
| 5,080,778 | 1/1992 | Lambert | 208/111 |
| 5,176,815 | 1/1993 | Lomas | 208/78 |

*Primary Examiner*—Helane Myers
*Attorney, Agent, or Firm*—Thomas K. McBride; John G. Tolomei

[57] ABSTRACT

A simplified solution to the problem of salt precipitation on the trays of a the FCC main column removes salt or salt forming compounds from an naphtha slip stream. The invention removes solubilized salt from the a cooled naphtha fraction of the main column by water washing to absorb dissociated ions of the salts and separation of the aqueous phase for removal of the salts from the separation loop.

11 Claims, 2 Drawing Sheets

DESALTING PROCESS FOR PRIMARY FRACTIONATOR

FIELD OF THE INVENTION

This invention relates generally to separation processes and more specifically to processes for the separation of wide boiling range product streams such as cracked vapors from the fluidized catalytic cracking (FCC) of heavy hydrocarbon streams.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed. The basic equipment or apparatus for the fluidized catalytic cracking of hydrocarbons has been in existence since the early 1940's and, along with its method of operation, is well known to those skilled in the an of hydrocarbon processing.

The cracked products from an FCC reaction section are delivered directly to product separation facilities associated with the FCC unit. These separation facilities include a primary separator, often referred to as a main column, and a compression section containing numerous separators and contactors for further separating overhead vapors from the main column. The compression section is commonly referred to as the gas concentration section. A key component of the compression is referred to as the wet gas compressor, which is a main source of energy for the gas concentration section.

Salt deposition in the primary separators of some FCC processes has created problems where solid salts form and accumulate on the surfaces of trays and cause plugging problems. The source of salt formation is primarily nitrogen compounds that enter with the FCC unit feed. Conditions in the reactor convert about 20–40 percent of the nitrogen compounds in the feed to ammonia which in the presence of sulfides or chlorides leads to the formation of water soluble salts such as ammonium chloride and ammonium sulfide. Salting in the trays principally occurs when the concentrations of dissociated salts exceed their saturation limits in the vapor of the primary separator. Precipitation of salts poses the most problems for the upper section of the primary separator where operating temperatures are the coldest and where vapor flow rates are generally the lowest.

The capacity of the separator to carry the salt as vapor is largely determined by the temperature of the vapor itself. The salting occurs more readily as the temperature of trays in the column drop. Lower tray temperature increasingly occur as the cut point of the overhead gasoline vapors is reduced to meet product specifications or as the proportion of water, and lighter hydrocarbons increase due to the severity of the cracking occurring in the reactor. Changes in upstream operating conditions such as the amount of heat extracted at the lower section of the column and lower operating pressures can also depress the temperature at the upper trays thereby increasing salting problems. In the FCC process lowering the reactor temperature to maximize distillate production would have a corresponding depression on temperatures in the main column. On the other hand, operating the reactor at very high temperatures to maximize conversion would generate a higher proportion of dry gas which would also tend to reduce the dew point temperature of the column overhead vapor. The condition of the catalyst also affects the generation of light gases. For example, if metal poisoning is severe, a high amount of $H_2$ will be generated.

Other operational changes, such as the quantity of steam used in upstream or downstream processing, can cause the vapor at the upper end of the column to approach or exceed water saturation limits. As the water concentration at the top of the separator column approaches saturation limits, it begins to condense on the trays and does not leave the system. As the water becomes saturated with these highly water-soluble salts the condensation of the water causes the salts to precipitate out on the tray with resultant plugging and corrosion problems.

The tendency to process increasingly heavier and contaminated (i.e. dirty feeds) raises the frequency and severity of salt precipitation problems. A direct remedy for preventing the precipitation of salts in separators has been upstream treatment of the hydrocarbon feed to the separator to remove salts and salt precursors. The expense and extra processing steps required for such treatments make them economically undesirable. Moreover, higher salt and contaminant levels raise the possibility of salt precipitation problems persisting even after such treatment.

Another known solution is the installation of a hot reflux system which enhances the exit of the salt with the hotter overhead vapors that are generated and withdrawn from the primary separator. Normally the hot reflux system partially cools the overhead vapor from the separator and recovers the condensate resulting from the partial cooling of the vapors in a hot reflux drum at higher temperature than the typical temperature of the net overhead product. The hot reflux drum provides a phase separation for withdrawal of a stream containing a high salt concentration aqueous phase and circulation of a hotter and heavier hydrocarbon stream back to the column which increases the temperature of the overhead section of the column. The hot reflux does not offer a completely satisfactory solution since it requires several additional pieces of equipment and the drum tends to be large since it receives the entire overhead vapor stream. In addition, there are many cases where, despite its cost, the addition of a hot reflux drum may not offer much advantage. For example, where the desired overhead cut is very light or when there is a significant proportion of LPG components in the overhead stream, the dew point of the total overhead material still remains low such that a salt saturated aqueous phase condenses out inside the separator and the salt removal from the reflux material is still insufficient to prevent salt accumulation and deposition on the trays.

BRIEF DESCRIPTION OF THE INVENTION

This invention provides a simplified solution to the problem of salt precipitation on the trays of a primary separator such as an FCC main column by removing salt or salt forming compounds from a naphtha boiling range stream that comprises the next cut point boiling above the overhead stream from the separator. The naphtha boiling range stream has solubilized salt removed from at least a cooled fraction by water washing to absorb salts or disassociated ions of the salts. Separation of an aqueous phase from the naphtha stream follows water washing for removal of the salts from the separation loop. Water washing may remove salts from a full naphtha cut but will preferably remove the salts from a slip stream of a full circulating naphtha stream.

The invention is particularly advantageous for FCC arrangements. The gas concentration section of the FCC unit may provide the wash water. The wash water may be boot water from locations such as the high pressure separator. The arrangement also permits higher salt concentration levels throughout the column that in turn permit greater amounts of wash water recycle to the reactor of the FCC unit. The elevated recycle reduces fresh water usage and sour water treatment costs.

Accordingly, in one embodiment, this invention is a process for the production and separation of an FCC product stream wherein the product stream contains dissociated salt forming ions. The process passes an FCC feedstock containing ionizable compounds and active catalyst particles to a reaction zone to convert the feedstock. The process separates catalyst particles from gaseous hydrocarbons to recover an FCC product stream containing dissociated salt. A primary fractionation zone receives the FCC product stream and separates the FCC product stream into fractions comprising a heavy hydrocarbon stream, a first naphtha boiling range stream containing dissociated salt and a gasoline stream. At least a portion of the first naphtha stream is cooled and then contacted with a wash water stream to absorb dissociated salt into the wash water and produce a wash water and hydrocarbon mixture. The process separates an aqueous phase from the wash water and hydrocarbon mixture to produce a second naphtha stream having a reduced concentration of dissociated salt relative to the first naphtha stream and returns at least a portion of the second naphtha stream to the primary fractionation zone.

The process of this invention permits the primary fractionation zone to operate at lower overhead temperatures when separating feeds with high salt concentrations which temperatures would, in the absence of this invention, cause a precipitation of salts on the upper trays of the primary fractionation zone. Depending on overall salt concentration levels within the primary separator, this invention permits the upper level to operate at a temperatures as low as 140° to 220° F. Moreover, in addition to permitting the operation of the primary separator overhead section at lower temperatures, the FCC riser, as well as the primary separator can circulate water or steam with higher overall salt concentrations from the overhead receiver. Circulating aqueous streams from the overhead receiver decreases the expense of sour water treatment and/or disposal.

In other aspects of this invention, the wash water supply may be incorporated more fully with a traditional gas concentration section of an FCC unit. In such an arrangement the typical integration will utilize waste water from the high pressure separator of the gas concentration unit.

Other objects, embodiments and details of this invention can be found in the following detailed description of the invention.

BRIEF DESCRIPTION OF THE DRAWINGS

The FIGURE is a schematic flow diagram of a primary separator and gas concentration section that receives a product stream from an FCC reactor.

DETAILED DESCRIPTION OF THE PREFERRED EMBODIMENT

Figures 1, 2A, 2B:
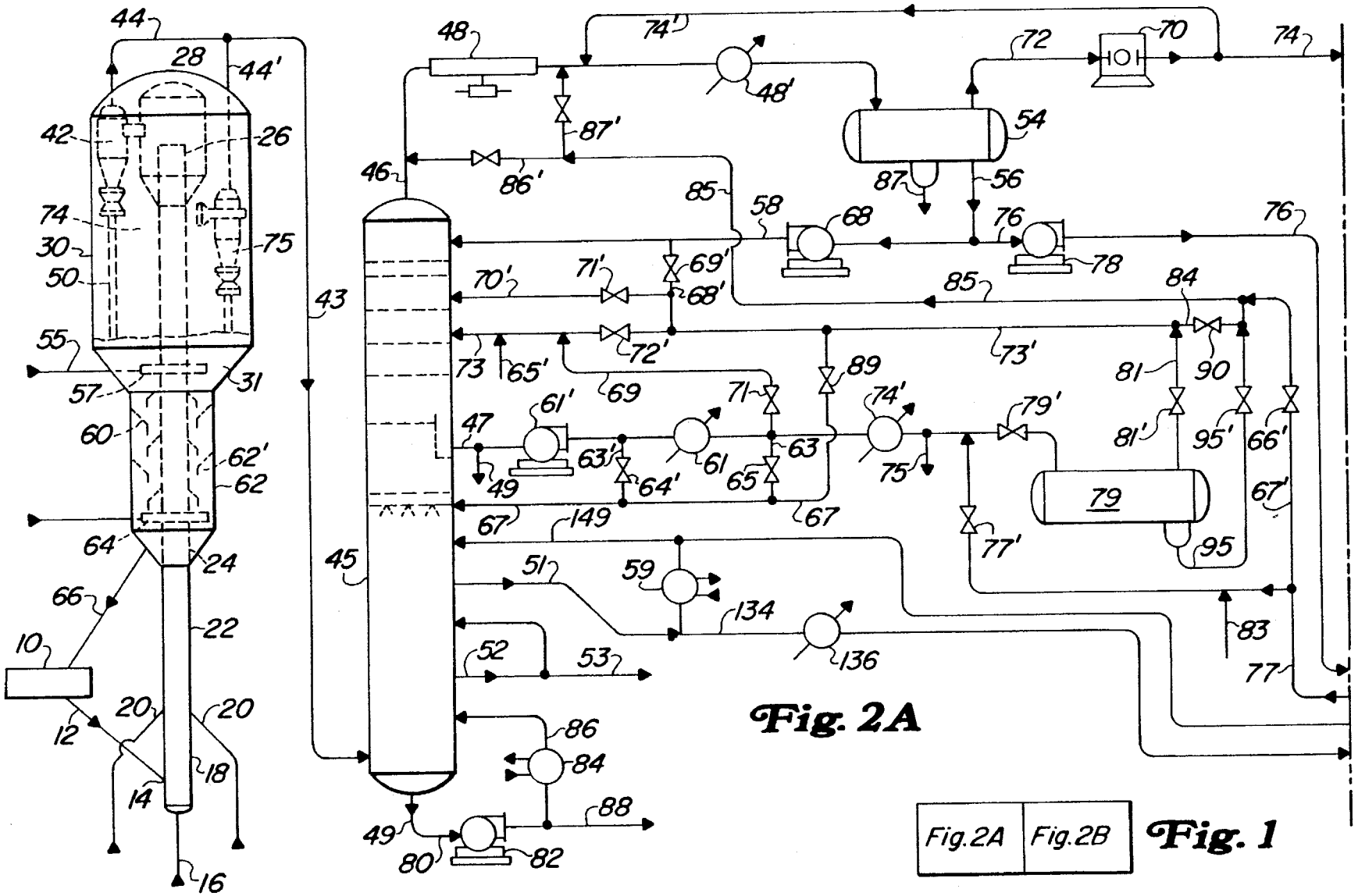
Figure 2B:
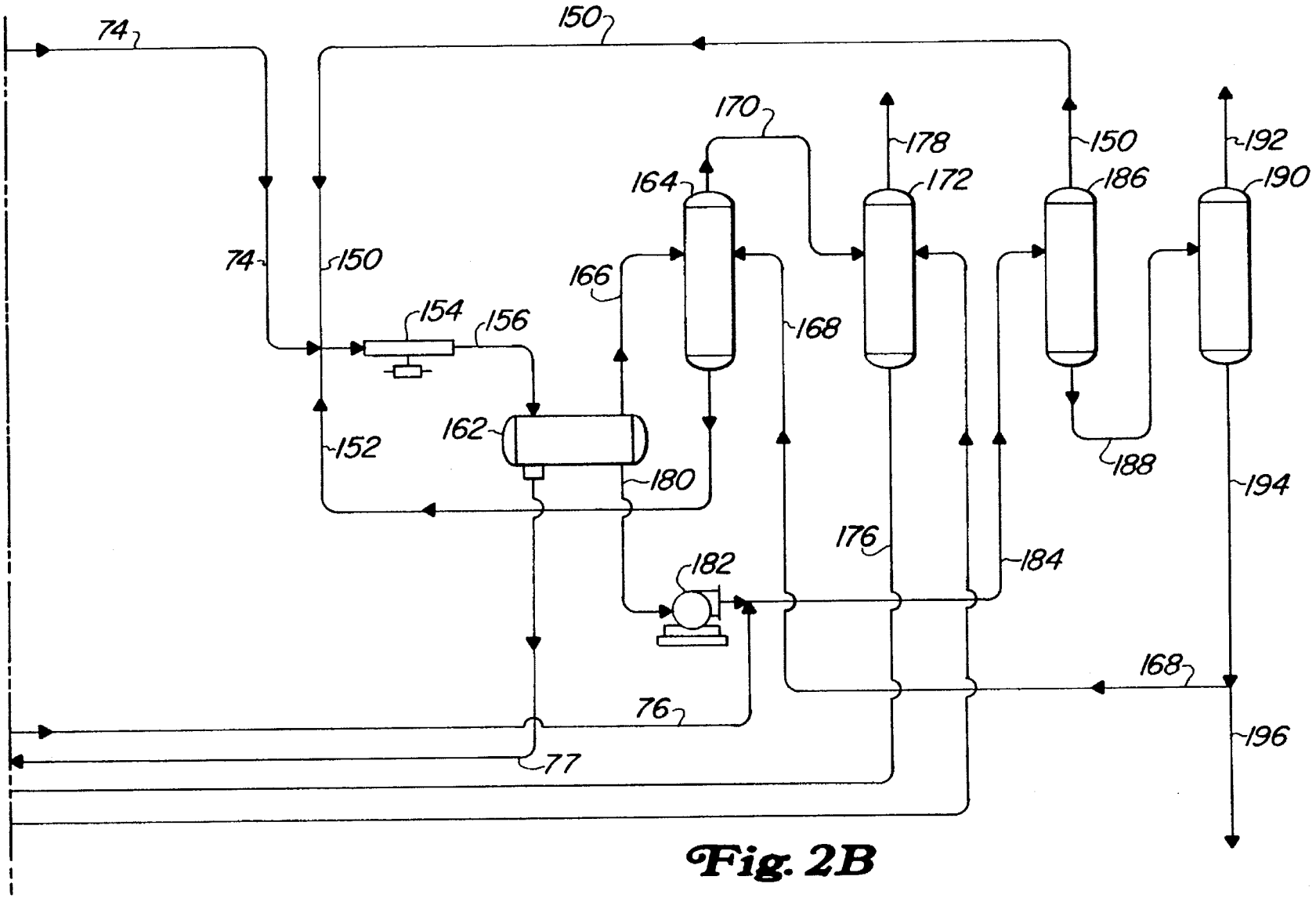

The process and apparatus of this invention is described in the context of the drawing. Reference to the specific configuration shown in the drawing is not meant to limit the process of this invention to the particular details of the drawing disclosed in conjunction therewith. The drawing is a schematic representation and omits many of the valves, instruments, pumps and other equipment associated with the arrangement of this invention when unnecessary for an understanding of the invention.

Referring then to the drawing, regenerated catalyst from a catalyst regenerator 10 is transferred by a conduit 12, to a Y-section 14. The FCC process will employ a wide range of commonly used catalysts which include high activity crystalline alumina silicate or zeolite containing catalysts. Zeolite catalysts are preferred because of their higher intrinsic activity and their higher resistance to the deactivating effects of high temperature exposure to steam and exposure to the metals contained in most feedstocks. Zeolites are usually dispersed in a porous inorganic carrier material such as silica, aluminum, or zirconium. These catalyst compositions may have a zeolite content of 30% or more. Particularly preferred zeolites include high silica to alumina compositions such as LZ-210 and ZSM-5 type materials. Another particularly useful type of FCC catalysts comprises silicon substituted aluminas. As disclosed in U.S. Pat. No. 5,080,778, the zeolite or silicon enhanced alumina catalysts compositions may include intercalated clays, also generally known as pillared clays.

The catalyst may first contact a lift gas injected into the bottom of Y-section 14, by a conduit 16, which carries the catalyst upward through a lower riser section 18. Lower riser section 18 serves as a lift gas zone which may or may not be used. Feed is injected into the riser above lower riser section 18 at feed injection points 20.

Feeds that may be used in conjunction with this invention include conventional FCC feedstocks or higher boiling hydrocarbon feeds. The most common of the conventional feedstocks is a vacuum gas oil which is typically a hydrocarbon material having a boiling range of from 650°–1025° F. and is prepared by vacuum fractionation of atmospheric residue. Such fractions are generally low in coke precursors and heavy metals which can deactivate the catalyst. Heavy or residual charge stocks are those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Various metal management or treatment procedures are known by those skilled in the an when processing such feeds.

The length of the riser will usually be set to provide a residence time of between 0.5 to 10 seconds at average flow velocity conditions. Other reaction conditions in the riser usually include a temperature of from 875°–1050° F. Typically, the catalyst circulation rate through the riser and the input of feed and any lift gas that enters the riser will produce a flowing density of between 3 lbs/ft$^3$ to 20 lbs/ft$^3$ and an average velocity of about 10 ft/sec to 100 ft/sec for the catalyst and gaseous mixture.

Gas oil or residual feed contacting in the riser typically takes place under short contact time conditions. Maintaining short contact times requires a quick separation of catalyst and hydrocarbons at the end of the riser. Separation devices at the end of the riser that provide a quick separation of the catalyst from the riser vapors and also limit the transfer of vapors from the riser into the dilute phase zone of the reactor vessel are preferred. Preferred separation devices for the end of the riser will provide a low catalyst residence time and recover at least 90 wt. % of the vapors discharged from the riser.

In the arrangement of the FIGURE the mixture of feed, catalyst and lift gas travels up an intermediate section 22 of the riser and into an upper internal riser section 24 that terminates with an upwardly directed outlet end 26. The reactor riser depicted in the FIGURE discharges into a device that performs an initial separation between the catalyst and gaseous components in the riser. The term "gaseous components" includes lift gas, product gases and vapors, and unconverted feed components. Riser end 26 is located in a separation device 28 which, in turn, is located in a reactor vessel 30. The separation device removes a majority of the catalyst from the cracked hydrocarbon vapors that exit riser end 26. The open end of the riser can be of an ordinary vented riser design as described in the prior art or of any other configuration that provides a substantial separation of catalyst from gaseous material.

A preferred manner of separating catalyst from the cracked hydrocarbon vapors displaces riser gaseous components from the catalyst leaving the riser by maintaining a dense catalyst bed adjacent to the riser outlet that is separated from a larger dense bed 31 in the reactor vessel. This dense bed location minimizes the dilute phase volume of the catalyst and riser products, thereby avoiding problems of prolonged catalyst contact time and overcracking. The use of the dense bed in the reactor vessel is more fully explained in U.S. Pat. No. 5,176,815, the contents of which are hereby incorporated by reference.

Cyclone 42 receives the cracked vapors from the separation device and removes essentially all of the remaining catalyst from the riser vapor stream or riser product stream. Separated catalyst from cyclone 42 drops downward into the reactor through dip legs 50 into catalyst bed 31. Conduit 44 withdraws the riser vapors from the top of the cyclone 42 and combines them with another gaseous stream recovered from a line 44'.

Catalyst removed by separation device 28 falls into dense catalyst bed 31. Reactor vessel 30 has an open volume above catalyst bed 31 that provides a dilute phase section 74. Catalyst collecting in bed 31, although coning a relatively high coke concentration, still has sufficient activity for catalytic use. Typically, the coke concentration of the catalyst in this bed will range from 1.5 to 0.6 wt. %. Bed 31 supplies a high inventory of catalyst that is available for contact with a secondary feed if desired. The FIGURE depicts a secondary feed entering reactor 30 through a line 55 with a distributor 57 disbursing the feed over the bottom of bed 31.

Catalyst cascades downward from bed 31 through a series of baffles 60 that project transversely across the cross-section of a stripping zone 62' in stripper vessel 62. Preferably, stripping zone 62' communicates directly with the bottom of reactor vessel 30 and more preferably has a sub-adjacent location relative thereto. As the catalyst falls, steam or another stripping medium from a distributor 64 rises countercurrently and contacts the catalyst to increase the stripping of adsorbed components from the surface of the catalyst. A conduit 66 conducts stripped catalyst into catalyst regenerator 10 which combustively removes coke from the surface of the catalyst to provide regenerated catalyst.

The countercurrently rising stripping medium of stripping zone 62' desorbs hydrocarbons and other sorbed components from the catalyst surface and pore volume. Stripped hydrocarbons and stripping medium rise through bed 31 and combine with any secondary feed and any resulting products in the dilute phase 74 of reactor vessel 30. At the top of dilute phase 74, an outlet withdraws the stripping medium and stripped hydrocarbons from the reactor vessel. One method of withdrawing the stripping medium and hydrocarbons is shown in the FIGURE as cyclone 75 which separates catalyst from the reactor vessel product stream. A line 44' withdraws the reactor vessel gases from the cyclone and out of reactor vessel 30 where it may be combined with the rest or reactor products or recovered separately.

A conduit 43 carries the cracked vapors and steam from lines 44 and 44' to a primary separation zone comprising a main column 45. Main column 45 fractionates the feed into at least four streams comprising a gas stream, naphtha stream, a cycle oil stream and a heavy oil or residual stream. The FIGURE shows primary separator 45 withdrawing an overhead stream 46 containing gasoline, a heavier fraction 47 comprising a naphtha boiling range stream, a next higher boiling cut in a stream 51 comprising a light cycle oil, a yet higher boiling fraction 52 comprising heavy cycle oil and a heavy hydrocarbon bottoms stream 49.

As known to those skilled in the art, a gasoline fraction can be further subdivided by the main column or by other means into heavy and light gasoline cuts. The light gasoline fraction is typically withdrawn with an initial boiling point in the $C_5$ range and an end point in a range of 300°–400° F. and preferably at a temperature of about 380° F. The cut point for this fraction is preferably selected to retain olefins which would otherwise be lost by additional cracking to lighter components and saturation by the recycle of the heavy gasoline fraction or the cut point may be controlled to optimize the octane barrels for the gasoline pool. The heavy gasoline cut ordinarily comprises the next heavier fraction boiling above the light gasoline fraction. The naphtha stream of this invention generally corresponds to the heavy gasoline cut and will typically have a lower cut point in a range of from 250° to 380° F. and an upper cut point in a range of from 380° F. to 480° F. At the operating conditions of the main column, this upper cut point will be at about the boiling point of $C_9$ aromatics, in particular 1,2,4-trimethylbenzene. A lower cut point temperature for the naphtha fraction, down to about 320° F., but preferably above 360° F., will bring in additional $C_9$ aromatics. In its most basic form, the upper end of the naphtha cut is selected to retain $C_{12}$ aromatics. Therefore, naphtha will usually have an end point of about 400°–430° F. and more preferably about 420° F. The entire light gasoline fraction and where desired part of the naphtha stream may enters a gas concentration section that uses a primary absorber and, in most cases, a secondary absorber to separate lighter components from the gasoline stream using fractions from the main column or the gas concentration section as adsorption streams.

The light cycle oil fraction via conduit 51 will comprise the next hydrocarbon fraction having a boiling point above the heavy gasoline stream and will usually have an end boiling point in a range of about 450°–700° F. A line 134 withdraws a net portion of the light cycle oil stream for product recovery and/or use as an absorption medium in the gas concentration section. Any net product stream of light cycle oil typically undergoes steam stripping (not shown) to meet flash point requirements before it is sent to product storage. A circulating light cycle oil fraction can also serve as a reboiling medium for one or more columns in the Gas Concentration section. The remainder of the light cycle oil stream is cooled in exchanger 59 and refluxed to the column 45 via a line 149.

The heavy cycle oil will have a boiling point in a range of about 500°–750° F. After withdrawing a net portion of the heavy cycle oil for recycle to the riser or as a net product via stream 53, the remainder is typically heat exchanged for heat recovery and recycled to the main fractionator. The heavy cycle oil stream will also normally provide a 475° to 650° F. hot stream for reboiling one or more columns in the gas concentration section. The recovered energy is also utilized to provide the final preheat for the feed to the riser and for the generation of *high pressure* steam. At other times, a net amount of this stream is withdrawn and recycled with the fresh feed to the reactor riser.

A portion of the heavy hydrocarbon stream from line 49 passes, via line 80 and pump 82 through a heat recovery exchanger 84 and returns to the main fractionator via line 86. The remaining portion of the heavy hydrocarbon stream is withdrawn by line 88 for other processing such as recycle to the riser and or recovery as a net product stream.

The embodiment depicted by the figure shows the gasoline stream 46 going overhead through a primary condenser 48, a trim cooler 48' and into a separator 54. Line 56 withdraws gasoline boiling range liquid from the bottom of separator 54 and refluxes a portion back to fractionator 45 via line 58 and pump 68. Wet gas compressor 70 takes overhead gas from receiver 54 via line 72 and discharges the compressed gas through a line 74 to the gas concentration section. A compressor spill back line carries a small portion of the compressed gas from line 74 back to line upstream of trim cooler 48'. Pump 78 transfers liquid from receiver 54 to the gas concentration section via line 76.

The naphtha stream that undergoes washing according to this invention is withdrawn from a tray via line 47. A portion of stream in line 47 may be withdrawn immediately via line 49 as a hot naphtha withdrawal for transfer to a naphtha sidecut stripper (not shown) and direct product recovery for blending or other purposes. With or without a direct withdrawal of the naphtha stream, a pump 61' pumps the remainder of the stream through line 47 for optional direct return of a portion of the stream to a lower column location via line 63' and reflux line 67 at a rate regulated by a control valve 154' and transfer of the rest of the stream through an exchanger 61. A portion of cooled, but unwashed naphtha from exchanger 61 may be returned directly to the lower column location via line 63 at a rate controlled by a valve 65 that delivers the unwashed naphtha to a reflux line 67. Unwashed naphtha may also be recycled after heat exchange to an upper tray location via a by-pass line 69 at a rate regulated by a control valve 71 which feeds the naphtha into a pumparound line 73. Further cooling of the naphtha stream may take place in a trim cooler 74'. Trim cooler 74' guards against possibility of water flashing when it hits the hot naphtha. A portion of the cooled naphtha may also be withdrawn via line 75 as an alternate to the take off of hot naphtha withdrawal for stripping or storage as product and blending stock.

A wash water stream from a line 77 enters line 47 at a rate regulated by a control valve 77' and contacts the remaining naphtha in line 47 which then enters a wash drum 79 after passing through a mixing device 79'. Additional fresh water may be injected into line 47 by a line 83. Alternately the entire wash water stream entering line 77 may be fresh water. Wash drum 79 allows a phase separation to occur between the aqueous and the washed naphtha streams to produce a de-salted naphtha stream taken overhead from the liquid-full wash drum via line 81 at a rate regulated by a control valve 81'. Line 81 supplies de-salted naphtha to line 73' which returns the de-salted naphtha via line 73 to an upper tray location within primary separator 45. Gasoline boiling range liquid from 58 may also be combined with the washed naphtha stream via a line 68' at a rate regulated by a control valve 69' and transferred column 45 via a line 70' at a location above the feed point of line 73. When washed naphtha returns to the column via lines 70' and 73 the relative proportions are balanced by valves 71' and 72'. Additional wash water may be injected into line 73 via line 73' and a line 65' to perform de-salting and remove any accumulated salts within the column. When additional wash water enters via line 65' it may comprise wash water from a separator or fresh water. When necessary for heat balance control line 73 could function as a source of cooled desalted naphtha to reflux line 67 at a rate regulated by control valve 89 for reflux to the column as an alternate for the hot unwashed material from lines 63 or 63'.

Salt laden wash water recovered from drum 79 is taken from a lower boot via a line 85 at a rate regulated by a control valve 85' and transferred to line 46 for the recovery of sour water from the column overhead system. The salt laden water may be returned upstream or downstream of main condenser 48 via lines 86' or 87'. In some cases additional water may be split from the line 77 by a line 67' at a rate regulated by a control valve 66' and added to line 85. This optional splitting of the wash water from line 77 sends only the minimum amount of wash water to wash drum 79 that is required to accomplish the desalting requirement of the system. The combined column overhead and wash water enters drum 54 and sour water is removed, after phase separation, from the boot of the drum 54 through a line 87. A portion of the de-salted naphtha may be recombined with the salt laden water for circulation through the overhead system and by-pass the overhead section of the column completely via a by-pass line 89 at a rate regulated by a control valve 90. Bypassing of a portion of the desalted naphtha is possible when permitted by heat and material balance requirements of the overhead system and reduce energy requirements since the bypassed liquid does not have to be vaporized.

Additional product recovery takes place in a traditional FCC gas concentration section. Compressed overhead vapor from the gasoline stream taken via line 74 combines with a stripper overhead from a line 150 and a primary absorber bottoms stream in line 152. After further cooling in condenser 154 the contents of line 156 enter a high pressure receiver 162. Gas from the high pressure receiver passes into a primary absorber 164 via line 166. The primary absorber contacts the gas with a gasoline product stream 168 for recovery of $C_3$ and higher boiling hydrocarbons and separate C2 and lower boiling fractions from the gas to the primary absorber. The off gas from the primary absorber passes via a line 170 to a secondary or sponge absorber 172. The secondary absorber contacts the off gas with light cycle oil from a line 174 after cooling of the light cycle oil in exchanger 136. Light cycle oil from line 174 absorbs most of the remaining $C_4$ and higher hydrocarbons and returns a bottoms stream to the main fractionator via lines 176 and 149. A line 178 withdraws off gas from the secondary or sponge absorber for use as fuel gas. A line 180 passes liquid from high pressure separator 162 through a pump 182 and, via line 184, into a stripper 186 which removes most of the $C_2$ and lighter gases and supplies a liquid stream 188 to a debutanizer 190. $C_3$ and $C_4$ hydrocarbons from debutanizer 190 are taken overhead by line 192 for further treatment. A line 194 withdraws debutanized gasoline for recycle to the primary absorber and to supply a net debutanized gasoline product stream 196. A waste water stream withdrawn from the bottom of drum 162 supplies wash water via line 77 for washing the naphtha stream and for the primary fractionation overhead stream.

EXAMPLE

The following example shows the use a water wash system of this invention to remove salt from a primary separator that receives the vapor stream of an FCC reactor. This example is based on engineering calculations and operating data obtained from similar systems and operating FCC units. The table sets forth two cases. The conditions for the two cases are identical except that the first case does not use the wash drum of this invention to wash a circulating naphtha stream, but instead operates with higher reflux and less naphtha product sidecut in order to keep the overhead temperatures high. In the first case the overhead temperature was kept high so the salt formation would not occur when processing a typical feedstock. In the second case the naphtha product sidedraw is increased and additional pump around heat in the naphtha section is made available for recovery. The resulting overhead temperature is much lower than desirable, but with the naphtha wash incorporated, salt formation is avoided.

| Case: | Case 1 (Typical Design) | Case 2 (With Naphtha Wash) |
|---|---|---|
| Fractionator Overhead Temperature, Deg. F. | 251 | 216 |
| Nominal Unit Capacity, BPSD (barrels/stream day) | 50,000 | 50,000 |
| Total Feed to Main Fractionator, Lb/Hr | 722,218 | 722,218 |
| Heavy Oil Product, BPSD | 5208 | 5208 |
| Light Cycle Oil Product, BPSD | 9896 | 9896 |
| Naphtha Sidedraw Product, BPSD | 3499 | 5588 |
| Ovhd Receiver Vapors to Compressor, MMSCFD | 57.64 | 58.52 |
| Net Ovhd Receiver Liquid, BPSD | 18338 | 15640 |
| Overhead Reflux Rate, BPSD | 35207 | 7820 |
| Stabilized Ovhd Gasoline, BPSD | 23716 | 21627 |
| Heat Recovery and Condensing Duties, MMBtu/Hr: | | |
| Circulating Bottoms Exchangers | 132.1 | 132.1 |
| Circulating Heavy Cycle Oil Exchanger | 51.71 | 51.71 |
| Circulating Light Cycle Oil Exchanger | 24.77 | 24.77 |
| Circulating Naphtha Heat Exchangers | 8.79 | 77.99 |
| Circulating Naphtha Cooler | 0.00 | 5.52 |
| Product Naphtha Cooler | 3.95 | 6.32 |
| Overhead Main Condenser | 130.02 | 67.15 |
| Overhead Trim Condenser | 58.16 | 44.30 |

In both cases an FCC unit is operated to process 50,000 barrels/stream day of a vacuum gas oil feed. The feed is contacted with a catalyst and lift gas mixture in the bottom of a reactor riser and enters a reactor vessel that operates at a pressure of about 20 psig. Lift gas consists of approximately 2 wt. % steam and 2 wt. % light hydrocarbon based on feed. An additional 2 wt. % of steam is injected to atomize the heavy oil feed. Product hydrocarbons are disengaged from the catalyst in the disengaging chamber and a riser cyclone. The catalyst travels downwardly through a first stage of a stripping section that operates at approximately the same temperature as the upper end of the reactor riser. Catalyst passing through the stripper is contacted with gas that enters the bottom of the stripper. The stripping gas first contacts the spent catalyst in the lower section of the stripper. The stripping gas removes absorbed hydrocarbons from the surface of the catalyst and the stripping gas becomes mixed with light paraffins and hydrogen. A quantity of stripping gas mixture equal to approximately 1.2 wt. % of the reactor feed is separated from the gases and vapors passing upwardly from the lower section of the stripper and are collected in an upper section of a reactor vessel. The gaseous mixture in the upper portion of the reactor vessel passes into the same cyclone separators that receive the riser products. All of the products, in the form of highly superheated vapors from the reaction zone, are transferred directly to a primary fractionation zone, where they are fractionated into fractions of various boiling point ranges and where the excess heat content of the total feed is recovered to the greatest extent practical.

At the bottom section of the column, both cases withdraw a net heavy oil product. The operating temperature in this section ranges from 650 to 725 degrees F., and 132.6 MMBtu/Hr heat in excess of that required for fractionation of the lighter components is recovered in a bottoms circulating stream.

Both examples have a heavy cycle oil (HCO) pumparound incorporated at a section above the bottoms section. 51.71 MMBtu/Hr of heat is recovered from this section in both cases.

The section above the HCO pumparound is the light cycle oil (LCO) product draw and circulation section. Net LCO product with a 450–700 deg. F. boiling range is netted from this section. Both cases recover 24.7 MMBtu/Hr of energy from this section.

The naphtha product and circulation section is located above the LCO section. The net naphtha product sidedraw with a typical boiling range of 250–450 deg. F., is processed in a steam stripper (not shown) in order to stabilize it and meet vapor pressure requirement. In these examples, the bulk of the circulating streams are heat exchanged for heat recovery and returned to the main fractionator. In case 1, 3499 barrels per stream day (BPSD) of net naphtha product is removed as a side draw and only 8.79 MMBtu/Hr of heat is recovered for heat exchange. In case 2 a 10000 BPSD portion of the circulating stream after the heat recovery exchanger is cooled further in a trim cooler and admixed with 50% of the total water coming from the high pressure receiver of the Gas Concentration unit, which in this case amounted to 27,132 lb of water. The resulting hydrocarbon/water mixture is allowed to separate in the washdrum, and the salt-laden aqueous phase recovered at 169 deg. C. is sent to combine with the rest of the wash water from the gas concentration section and is injected upstream of the overhead condenser. The washed naphtha is recycled back to the main fractionator after admixing with the main fractionator external reflux from the overhead receiver.

In case 2, the overhead operating temperature of the main fractionator is 216 deg. C., a temperature that under most situations would cause salt deposition inside the main column, for typical FCC feeds under similar conditions. In case 2 of the example the amount of naphtha sidedraw product has been increased to 5588 BPSD with resultant decrease in the mount of the stabilized overhead gasoline, and the reflux of the fractionator has been reduced to a minimum in order to maximize the energy recoverable in the naphtha pumparound stream, instead of the latter just being discarded with accompanying expense of energy, in the fractionator overhead condensers. From case 1 to case 2 the heat available for recovery increased from 8.79 to 77.99 MMBtu/Hr. The additional energy recovered from the naphtha section is used to preheat colder feeds and as a reboiling medium for the depropanizing column in the gas concentration section.

In both cases, the mixture of lighter gasoline components, C4 and lighter liquids, and the non-condensibles leave the top of the primary fractionator, combine with wash water and enter the main condenser. Wet gas compressor spillback joins with the main condenser effluent before it enters the fractionator overhead trim condenser. The vapors, hydrocarbon liquid, and the aqueous phases are allowed to separate in the overhead receiver. The gas phase is routed to the wet gas compressor of the Gas Concentration Unit and the hydrocarbon liquid phase is pumped to the Primary Absorber of the Gas Concentration unit: the C3's and heavier hydrocarbons that are recovered are charged to the Debutanizer of the Gas Concentration unit where C3's and C4's are recovered at the overhead section; and the Stabilized Gasoline product is recovered at the bottom section. The water phase is typically sent to a sour water treating system.

Case 2 of the example demonstrates the removal of salt from a circulating naphtha stream in a primary fractionator that operates with relatively cold upper column section without the deposition of salts on the trays contained therein.

We claim:

1. A process for the production and separation of a fluidized catalytic cracking (FCC) product stream wherein said product stream contains disassociated salt forming ions, said process comprising:

a) passing an FCC feedstock containing ionizable compounds and active catalyst particles to a reaction zone to convert said feedstock and produce a stream of gaseous hydrocarbons and catalyst particles;

b) separating catalyst particles from gaseous hydrocarbons and recovering an FCC product stream containing dissociated salt;

c) passing said FCC product stream to a primary fractionation zone;

d) separating said FCC product stream in said primary fractionation zone into fractions comprising a heavy hydrocarbon stream, a first naphtha boiling range stream containing dissociated salt and a gasoline stream;

e) cooling at least a portion of said first naphtha stream;

f) contacting a cooled portion of said first naphtha stream with a wash water stream to absorb dissociated salt in said wash water to produce a mixture of naphtha and wash water;

g) separating an aqueous phase from said mixture of naphtha and wash water stream to produce a second naphtha stream having a reduced concentration of dissociated salt relative to said first naphtha stream; and h) returning at least a portion of said second naphtha stream to said primary fractionation zone.

2. The process of claim 1 wherein said ionizable compounds comprise nitrogen compounds and said condensible ions comprise ammonium ions.

3. The process of claim 2 wherein said dissociated salt comprises ammonium chloride and ammonium sulfide.

4. The process of claim 1 wherein at least a portion of said aqueous stream is mixed with said gasoline stream, the mixture of said gasoline stream and aqueous stream is cooled and a sour water stream having a higher concentration of salt than said aqueous phase is separated from said gasoline stream.

5. The process of claim 1 wherein all of said first naphtha stream is admixed with said wash water.

6. The process of claim 1 wherein a wash water stream is admixed and returned with said second naphtha stream to said main fractionator.

7. The process of claim 4 wherein a portion of said second naphtha stream is admixed with said portion of said aqueous phase.

8. The process of claim 1 wherein said gasoline stream passes to a concentration section and at least a portion of said water wash is recovered from said concentration section.

9. The process of claim 1 wherein said primary fractionation zone has a temperature in its upper section of from 140° to 220° F.

10. The process of claim 1 wherein a portion of said first naphtha stream is returned to said primary fractionation zone after cooling and before mixture of said wash water.

11. The process of claim 8 wherein the portion of said wash water recovered from said concentration section comprises less than the total water recovered from said concentration section.

* * * * *